US005298119A

United States Patent [19]

Brown

[11] Patent Number: 5,298,119

[45] Date of Patent: Mar. 29, 1994

[54] SCREENING SYSTEM FOR FRACTIONATING AND SIZING WOOD CHIPS

[75] Inventor: Robert A. Brown, Wenatchee, Wash.

[73] Assignee: James River Corporation of Virginia, Richmond, Va.

[21] Appl. No.: 984,240

[22] Filed: Dec. 1, 1992

Related U.S. Application Data

[63] Continuation of Ser. No. 606,890, Oct. 31, 1990, abandoned.

[51] Int. Cl.[5] ..... D21D 5/02; D21D 5/20; D21D 5/22

[52] U.S. Cl. ..... 162/55; 209/672; 209/673; 209/678

[58] Field of Search ..... 162/55; 209/673, 678, 209/672

[56] References Cited

U.S. PATENT DOCUMENTS

| | | |
|---|---|---|
| 2,966,267 | 12/1960 | Dunbar . |
| 3,337,139 | 8/1967 | Lloyd et al. . |
| 3,819,050 | 6/1974 | Lower . |
| 4,043,901 | 8/1977 | Gauld . |
| 4,050,980 | 9/1977 | Schmidt et al. . |
| 4,167,438 | 9/1979 | Holz . |
| 4,234,416 | 10/1980 | Lower et al. . |
| 4,351,719 | 9/1982 | Morey . |
| 4,376,042 | 3/1983 | Brown . |
| 4,430,210 | 2/1984 | Tuuha . |
| 4,504,386 | 3/1985 | Dryen et al. . |
| 4,802,591 | 2/1989 | Lower et al. . |
| 4,903,845 | 2/1990 | Artiano . |

OTHER PUBLICATIONS

"A New Concept in Overthick Chip Screening" by Kendall Kraft and Shannon Javid of Acrowood Corporation, Everett, WA.

"An Albany Paper Mill case study-chip thickness screening, energy, and production" by Dan J. Parker, Jan. 1983.

"Pulping Yields Increases with Chip Thickness Screening" by John Clark, Rader Companies, Inc., Nov. 1983.

"Chip thickness screening, slicing system has three--month payback" by Brian Briscoe, Aug. 1985.

Pulp & Paper, Jun. 1980: "New Concept 'V' screen improves chip quality at Fiskeby AB mill" by James L. Keating.

"Eurocan improves chip quality with new thickness screening system" by Juan Villa (Pulp & Paper, Jul. 1983).

"Chip thickness screening at Eurocan" by J. Villa (Pulp & Paper, Canada 1985).

"Chip thickness screening system improves medium output, quality" by James B. Porter, Pulp & Paper, Jun. 1981.

"Weyco Begins Construction on Mississippi Pulp Mill" article in American Papermaker/Jan. 1989.

"Chip Thickness Screening System is Key to Pulp Quality at Manville" by John Stimac and Darrell Lynn (P&P, Apr. 87).

"Case History: Chip Screening Systems remove overthick and fines ahead of digesters" by Crown Zellerbach, Camas, Washington.

"Proper Selection of Chip Screening Systems" by Robert A. Brown and Lindsay M. Lancaster-Abstract.

"Keep Those Good Vibrations Happening at Your Mill" by Jackie Cox-American Papermaker/Feb. 1989.

"Advancing the state-of-the-art in screening bark-free and non-bark-free chips" by Elmer Christensen (Tappi/May 1976, vol. 59, No. 5).

*Primary Examiner*—Steve Alvo

*Attorney, Agent, or Firm*—Sixbey, Friedman, Leedom & Ferguson

[57] ABSTRACT

A flow management system and process for providing controlled separation and sizing of an incoming flow of wood chips. A flow management screen is provided in the form of a horizontal disk screen having a variable speed drive, with the drive controlled based upon the flow rate of wood chips to the screen. By controlling the rotational speed of the disks of the horizontal disk screen, the flow separation and sizing to subsequent screening stations can be predicted and controlled. As a result, more consistent output is provided, as well as improved system efficiency and ability to accommodate for varying operational conditions and wear.

4 Claims, 13 Drawing Sheets

SCREENING SYSTEM FOR FRACTIONATING AND SIZING WOOD CHIPS

This application is a continuation of Ser. No. 07/606,890, filed Oct. 31, 1990, now abandoned.

TECHNICAL FIELD

The invention relates to sizing of wood chips, and in particular, to a screening system and process for efficiently and economically providing a flow of wood chips which are sized such that the flow is acceptable for pulping.

BACKGROUND OF THE INVENTION

In pulping of wood chips, it has been recognized that the thickness dimension of the wood chips plays an important role in the quality of the pulping process. During pulping, a digester receives chips and through the use of chemicals, pressure and elevated temperatures, the wood is broken down into its constituents which include lignin and cellulose. The cellulose or wood fiber is then processed for making the pulp product. The thickness (or smallest dimension) of the chip is critical (as opposed to its length) since the thickness dimension determines the effectiveness of the digesting chemicals in penetrating to the center of the chip. As is recognized by those skilled in the art, in producing a uniform, high yield pulp, providing a correctly sized and composed chip flow is extremely important.

Oversized and overthick chips are not properly broken down in the digester and can result in a reduced pulp yield due to the subsequent removal of these particles during the pulping process. Undersize chips typically include pins and fines, with the pins comprising chips which are smaller than the desired chip size range, and fines even smaller particles, such as sawdust or small bark particles. The undersized chips should also be removed from the chip flow which is fed to the digester, since undersized material can be overcooked in the digester resulting in a weakening of the overall pulp. In addition, dirt and grit should be removed since they can also contribute to a weakening of the pulp.

Thus, it is necessary to provide a flow of chips to the digester which is acceptable from a standpoint of having low levels of overthick chips and low levels of undersized chips. While complete removal of oversized and undersized chips is not necessary, and in fact is not practically or economically possible, an acceptable flow to the digester should contain overthick chips below a certain percentage and undersized chips below a certain percentage of the overall flow. The particular percentages which are deemed allowable in an acceptable flow (to the digester) can vary from pulping mill to pulping mill.

Chip screening systems are well-known. Many screening systems in use today are described in an article by E. Christenson in the May 1976 TAPPI Journal, Vol. 59, No. 5. A gyratory screen is one type of screening device which provides high particle separation efficiency for given screen sizes. Gyratory screens have less of a tendency to upend and remove elongated particles such as pin chips, and there is less tendency to plug the screen openings with particles close to the screen opening size. Gyratory screens agitate the wood chips causing the smaller particles to vibrate downwardly for removal. In addition, gyratory screens have less tendency to abrade and break chips into smaller pieces.

Thus, gyratory screens are particular effective in separating pins, fines, dirt and grit from a wood chip flow.

Another typical screening device, as disclosed in the Christenson article is known as the disk screen. A disk screen contains a number of parallel rows of shafts upon which spaced rotating disks are mounted such that the disks on one shaft are axially spaced between the disks on an adjacent shaft. The spacing determines the size of the chip that will fall through and those that will stay atop and pass over the screen. When the chip flow is large, and deep, a smaller proportion of the chips will have access to the spacing or slots between the disks. As described in the Christenson article, the disk screen will separate "overs" or, in other words, oversized and overthick chips, from the remainder of the flow, since the "overs" will generally not pass through the spacing between disks of adjacent shafts of the disk screen.

In one system described by Christenson, it is suggested to first pass an incoming chip flow over a disk screen to remove the "overs" fraction. The fraction which passes through the disk screen, i.e., between the disks of adjacent shafts, will contain the chips which are acceptably sized as well as pins, fines, sawdust, etc. The "overs" will be processed further to reduce their size to within a predetermined acceptable size of ranges, for example, for utilizing a chip slicer. The system method is the most commonly practiced today and is known as a "Primary Thickness Control", since the Primary Thickness controlling unit is the first stage in the process.

Another chip sizing process is disclosed in U.S. Pat. No. 4,376,042 to Brown, in which an incoming flow of chips is divided into three fractions utilizing a gyratory screen. One fractional output includes an acceptable flow of chips. A second fraction includes acceptable chips as well as oversized and overthick chips. The second fraction is directed to a disk screen which separates the overthick and oversized chips from the acceptable chips. The acceptable chips from the second fraction, as well as the acceptable chips from the first fraction are then fed to the digester. The third fraction includes the undersized chips which are then removed from the system, and may be transported to a fuel bin.

The process described in the Brown patent was implemented in 1986 at the Weyerhaeuser Longview, Washington Mill. The Weyerhaeuser/Brown process has proven successful in providing a "sustained, high performance" chip thickness and chip uniformity system as well as providing a low maintenance operating system. This process is utilized as a high performance chip thickness and uniformity system and currently ten systems utilizing this process are in use or are under construction. While the relatively new Weyerhaeuser process is a significant advance in the industry, it is important to note that systems which utilize a primary disk thickness screening process exceed 140 in the industry.

While the use of a disk screen as a primary thickness screen (in which overthick and oversized chips are separated from an incoming flow) has gained widespread acceptance, it is constantly a goal to provide improved chip screening systems which can provide acceptable chip flows to digesters as economically as possible. Moreover, it is important that any such improvements be compatible with existing systems, such that existing systems may be retrofitted, thereby avoiding the tremendous capital outlay required for completely new systems.

SUMMARY AND OBJECTS OF THE INVENTION

Applicants have recognized the advantageous use of a flow management screen which is upstream of other final screening stations. The flow management screen bears the brunt of the mechanical wear, thus protecting the main thickness screening unit, which tends to be more expensive. The flow management screen also provides an initial flow separation which allows for more effective sizing separation by downstream screens. In particular, often the main thickness screening unit is in the form of a V-screen (which is utilized as the main or primary thickness screen in the "Primary Thickness Control" system), however, the V-screen is extremely expensive. In addition, in a V-screen, the flow is parallel to the shaft axes, such that the V-screen wears more rapidly, as compared to a horizontal disk screen.

Utilizing a flow management screen (for example, in the form of a horizontal disk screen) upstream of the main thickness V-screen, can allow the system to operate at higher flow rates, while separating the pins, fines, dirt and grit prior to the flow reaching the main thickness screen. Since the pins, fines, dirt and grit are generally more abrasive to disk screens, the wear on the main thickness screen is reduced. Thus, the wear of the main thickness screen is reduced for two reasons (1) there is less exposure to the smaller abrasive particles; and (2) the total proportion of the system flow which the main thickness screen is exposed is reduced, since the flow management screen provides an initial separation of the flow.

In accordance with the present invention, Applicants have further recognized that the flow management screen can control the proportion of flow which is directed to the main thickness screen (i.e., that which flows over the flow management screen) as compared to the proportion of the flow which flows through the flow management screen (i.e., between the disks). The flow passing through the flow management screen may then be fed to a screen more suitable for removal of pins, fines, dirt and grit, hereinafter "the unders screen", with accepts from the unders screen joining accepts from the main thickness screen for feeding to the pulp digester. Note, however, certain mills having low quality standards do not require removal of unders, and therefore the accepts from the flow management screen will join the flow which flows through the main thickness screen, while the overs from the main thickness screen will be passed to a size reduction device such as a chip slicer which will reduce the size of the over.

In accordance with the present invention, Applicants have realized that by controlling the proportions of flow from the flow management screen, the removal efficiencies of the overs and unders can also be controlled. Further, these proportions can be controlled by controlling the rotational speeds of the disks in a horizontal disk flow management screen. In the past, while not all disk screens (from site to site) were run at the same speed, each of the disk screens have been run at constant rotational speeds. Applicants have recognized the use of a variable speed disk screen for controlling the proportion of flow over and through the flow management disk screen. Thus, the amount and composition of flow to the main thickness screen or the unders screen can be controlled.

The controlled flow management is advantageous in that varying conditions in the system can be accommodated, while maintaining satisfactory removal of overs and unders from the respective flows through and over the flow management screen. For example, as the incoming flow varies, the flow management screen can be controlled to continue to provide the same proportional separation despite the varying incoming flow. In addition, the amount of overs directed to the chip slicer can be controlled to accommodate situations where the chip slicer is overloaded. The overs can then be finally removed at the main thickness screen (typically a V-screen), and the unders can be removed by the unders screen.

A further advantage of controlled flow management resides in the ability to accommodate wear of the flow management screen. Applicants have recognized that the flow separation can be predicted based upon the disk spacing, the incoming flow rate, and the rotational speed of the disks. After a period of use, the disks become bent or otherwise worn such that the screen may act as though the spacing has changed. In particular, a new screen is generally designed with an IFO (interface opening) rating within a certain standard deviation. After the screen wears, the nominal IFO may be the same, however, certain spacings will be larger and some may be smaller such that the standard deviation will be much greater than with a new screen. In accordance with the present invention, Applicants have recognized the change resulting from wear can be accommodated for by viewing the screen as having a different nominal IFO. The performance of a worn screen for various operating conditions can therefore be predicted by selecting an IFO, for modeling purposes, which approximates the actual performance of the worn screen. Thus, the desired removal efficiencies can be attained despite wear of the screen.

The present invention can provide predictable flows so that desired flow compositions can be attained despite varying incoming loads and screen wear. In addition, where it is desired to suddenly change loading conditions drastically, it is possible to control the flow management screen such that the maximum flow is attained. This may involve a small sacrifice in removal efficiencies, however this sacrifice can be predicted and weighed against the desire for increased flow. For example, often two screening lines or systems will operate from a central infeed distribution system. If one line should go down, the amount of chips in the hopper can rapidly increase. Rather than simply operating at one-half capacity, a decision could be made to vary the removal efficiency (of the flow management screen) of overthick, for example, by 4%, and the flow management screen can be controlled such that the maximum flow rate at a reduced separation efficiency is attained, such that the overall system capacity may be reduced to 70% rather than 50% (i.e., as compared to the operation of the system with two functioning lines). Thus, the flow management screen can avoid an extreme slowdown (for example, where a single line goes down) since the controlled flow management screen can accommodate increased incoming loads, while maintaining removal efficiencies within acceptable limits. This is considered to provide significant operational flexibility over present systems.

In addition, in a situation where the chip slicer (or other size reduction device) is overloaded, it is possible to decrease the proportion of chips fed to the primary thickness screen, and increase the amount passing through the flow management screen, such that the feed of the overs to the slicer is reduced. Furthermore, since the flow composition can be more readily predicted with controlled flow management, adjustments may be made depending upon the particular species of chips which are being sized and fed to the pulp digester, since the digesting chemicals may more readily penetrate certain types of chips. For example, it may be desired to remove more 10 mm or more 8 mm chips for one species versus another.

It is therefore an object of the present invention to provide an improved screening system and a process for efficiently and economically providing an acceptable flow of wood chips to a pulping digester.

It is a further object of the present invention to provide a screening system/process in which the separation and sizing of a flow of wood chips can be more accurately controlled.

It is another object of the invention to provide a screening system which includes a flow management screen which receives an incoming flow and controlledly separates the flow for feeding to one or more downstream feeding stations.

It is yet another object of the present invention to provide a controlled flow management screen which can provide a substantially consistent proportional separation of an incoming flow despite variations in the incoming volume feed rate to the flow management screen.

It is yet another object of the present invention to provide a wood chip sizing system/process in which chips are fed from a hopper or other central distribution system, with the feed rate from the hopper to a first screening station varied to prevent overloading of the hopper (or other central distribution) while the flow separation by the first screening station is substantially consistent despite varying feed rates.

It is a still further object of the invention to provide a chip sizing system/process in which a first screening station or flow management screen can be controlled to provide a desired separation or sizing despite wear of the flow management screen thus extending the flow management screen's useful life.

These and other objects and advantages are achieved in accordance with the present invention in which the rotational speed of the disks of a horizontal flow management screen are controlled by a programmed logic control unit such that a consistent flow separation or sizing is provided for a particular feed rate. In addition, the desired separation may be adjusted so that extremely large increases in flow rates may be accommodated. The programmed logic may also be modified to accommodate for wear of the screen. Other objects and advantages will become apparent from the following description read in conjunction with the drawings.

DETAILED DESCRIPTION OF THE PREFERRED EMBODIMENTS

Figure 1:
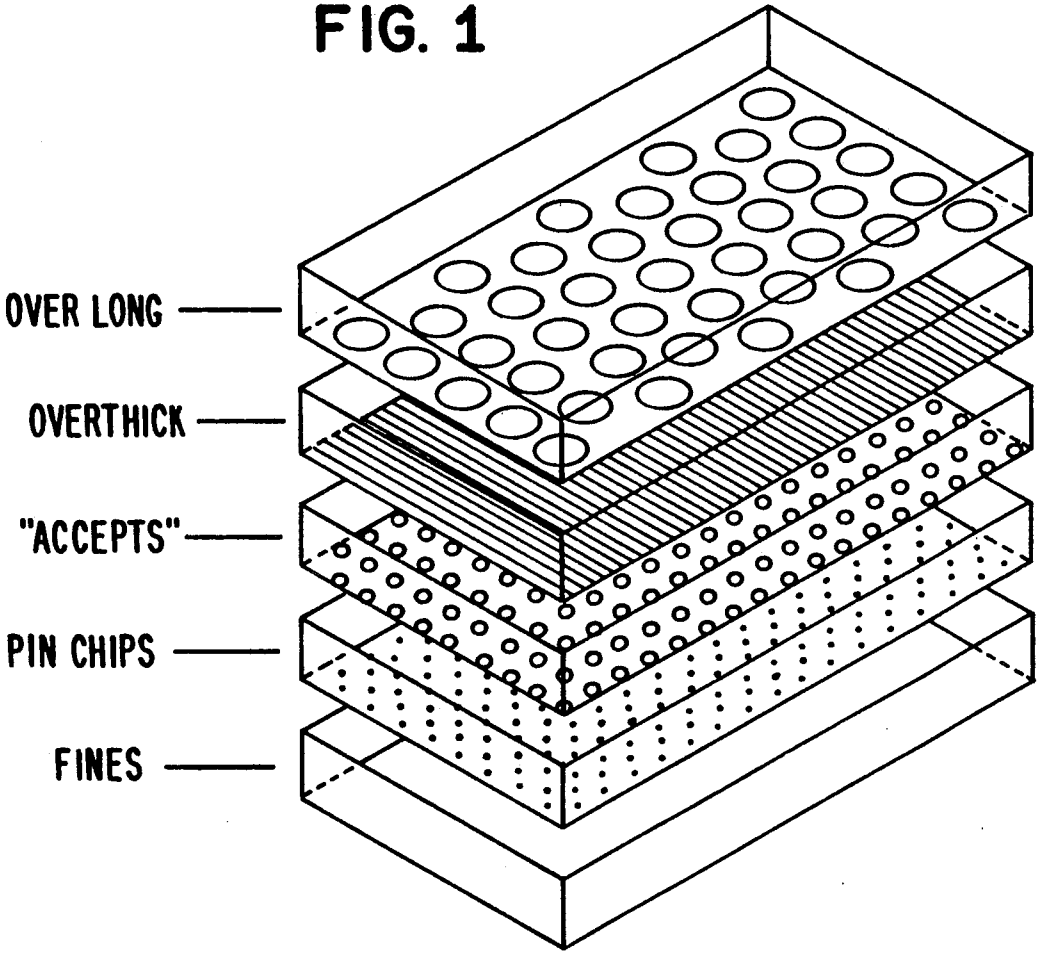
FIG. 1 illustrates various sampling screens utilized in evaluating the size composition of a sample of wood chips.

FIG. 1 illustrates sizing screens which are utilized for sizing and evaluating flow samples. The screen designated "Over Long" retains larger wood portions and wood chips, of 45 millimeter or greater. The "Overthick" screen includes a plurality of slots for retaining chips above a certain thickness. Note that more than one overthick screen may be utilized, for example, one which would retain chips over 10 millimeter, and another for retaining chips over 8 millimeter, but which would not be retained in the 10 millimeter screen. The "Accepts" screen retains chips which pass through the larger screens, but which are larger than a selected lower size limit of the accepts aperture (for example 7 millimeter). Thus, the chips which would be retained by the screens above the accepts screens would be considered "Overs", while the chips which are passed through the overs screens, but which are retained by the accepts screen are considered accepts. Smaller chips which pass through the accepts screen are considered "unders", and may be further classified into smaller particles, for example, pin chips and fines. In evaluating various chip flows throughout a screening process, samples are taken and evaluated utilizing screens as shown in FIG. 1, such that the proportions of various sizes of chips can be determined.

Figure 2:
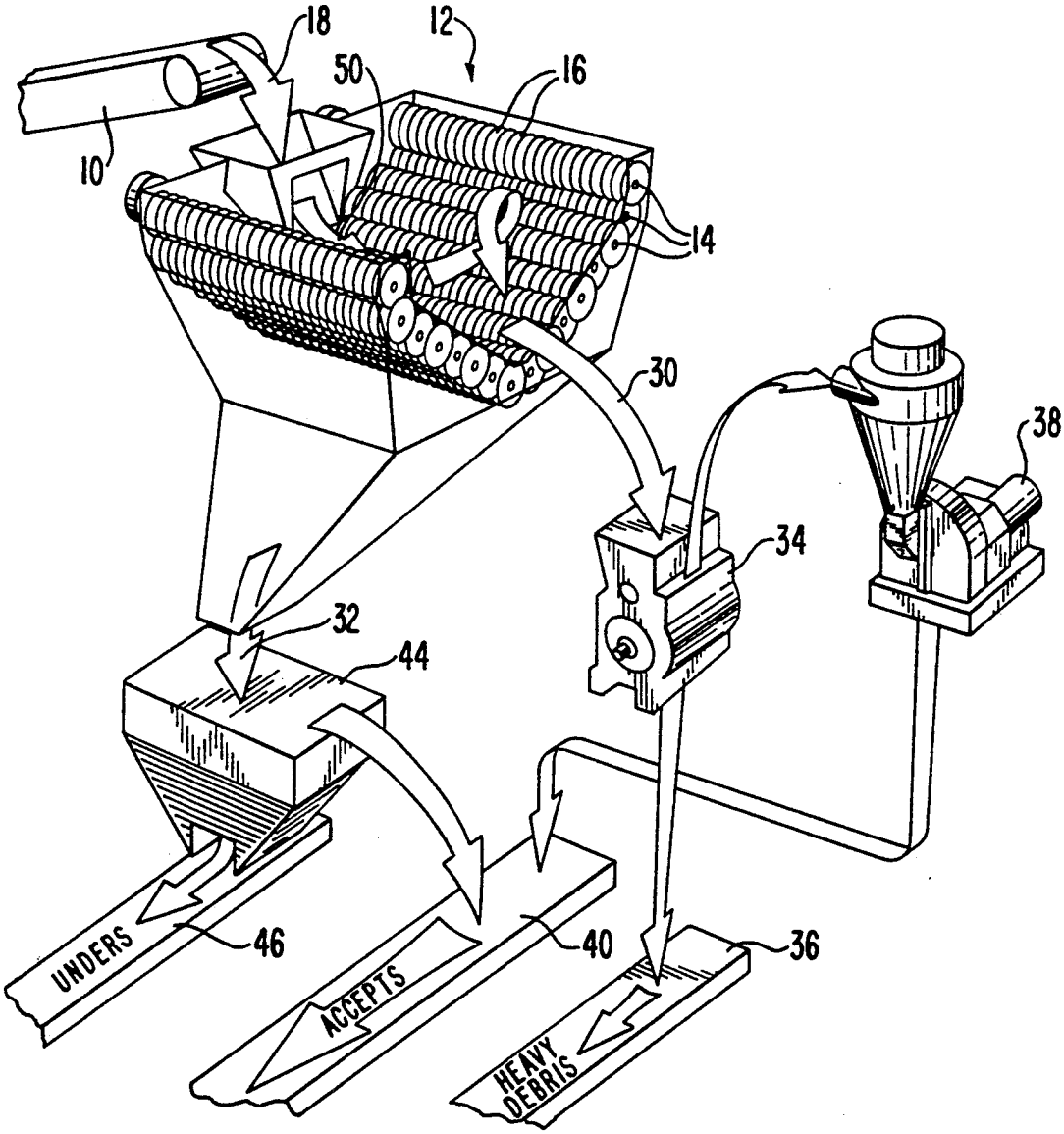
FIG. 2 (PRIOR ART)
FIG. 2 illustrates a conventional screening system.

Turning now to FIG. 2, a conventional screening system is shown. In the conventional system, an incoming flow of chips is fed by a conveyor 10 to a main or primary thickness screening unit 12. As shown in FIG. 2, typically the main thickness screen 12 takes the form of a V-screen having a series of shafts 14 arranged substantially in a V-shape, with a plurality of disks extending along the length of each shaft.

Figure 3:
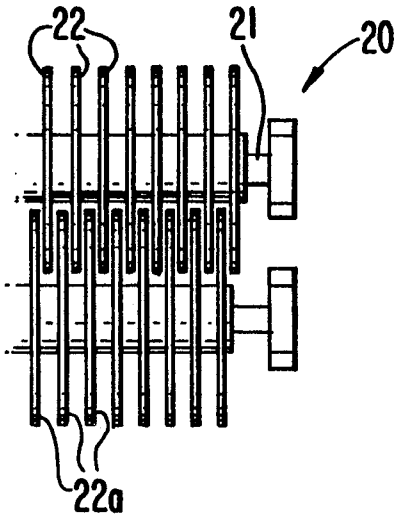
FIG. 3 is a partial view of adjacent shafts of a disk screen.

Turning briefly to FIG. 3, in both horizontal and V disk screens, each roll 20 includes a plurality of disks 22 which intermesh with disks **22*a* of an adjacent roll. The spacing between disks of adjacent rolls 22,22*a*** is referred to as the interface opening (IFO). In designing the screen, the selection of the IFO varies the ability of chips to pass between the disks, and thus varies the flow separation characteristics of the screen. Generally screens will be designed with a rated nominal IFO, with the screen having an acceptable IFO standard deviation for the entire unit. For example, a 7.0 millimeter screen may have a standard deviation of approximately 0.40 millimeter. In the manufacture of this screen, the disks are fixedly mounted upon the shafts. As the screen wears, while the nominal IFO, or average spacing between adjacent disks may remain substantially the same or vary slightly, the standard deviation will increase due to bending or abrading of the disks.

Referring back to FIG. 2, in the conventional system, the screen 12 will separate the incoming flow 18 into two flows: a flow of chips which pass over the screen 30, and those which pass through the screen 32. In the conventional system, the flow 30 includes the "overs", or oversized and overthick chips, which are fed to a separator 34 which separates heavy debris from the oversized and overthick chips. The debris is removed by a suitable conveyor 36, while the overs are processed by a slicer 38 which then feeds the sliced chips to the pulping digester by conveyor 40. The flow of chips 32 which pass through the main thickness screen 12 include both chips which are acceptable for feeding to the digester, as well as unders including the pins and fines. The flow 32 is then separated by a secondary screen unit or unders screen 44, which typically will be in the form of a gyratory screen. The gyratory screen 44 will separate the unders which can be fed to a fuel bin by a conveyor 46. The accepts from the gyratory screen are fed to the pulping digester by the conveyor 40. While the flow 18 is referred to as the incoming flow, generally a very gross screening device, such as a gross scalper, is provided upstream of the screen 12 as would be understood by one skilled in the art. The gross scalper removes extremely large wood and other debris, for example rocks, chunks of asphalt, two by fours, etc. For convenience, flow 18 is designated as the incoming flow as it is the flow to the screens responsible for thickness screening and separation.

A major disadvantage with the conventional system resides in the high capital cost of the V-screen which tends to wear rapidly. As the chips are fed over and through the screen, the disks will bend and abrade, thus increasing the standard deviation of the screen IFO. With the V-screen, since substantially the entire flow (i.e. after scalping) contacts the front disks, for example as shown at 50, these disks will wear more rapidly than those remote from the infeed. In addition to the increased flow volume at the front of the screen, the pins and fines are more prevalent at the infeed further increasing the propensity of the frontal disks to wear rapidly, since the smaller chips and particles tend to be more abrasive. As the screen wears, the ability to remove overs deteriorates rapidly, requiring repair or replacement of the screen. Since the disks are fixedly mounted on the shafts, an entire shaft may need replacement even though only a portion of the disks may be worn (i.e., the frontal disks).

A further shortcoming of the conventional system resides in the limited operational flexibility. Since the unders and accepts must be allowed to pass through the screen, the flow rate must be limited, to allow the unders and accepts access to the openings between the disks. If high flow rates are utilized, an undesirable proportion of unders and accepts will be carried with the overs into the flow 30. Thus the conventional system requires high operational costs, with rapidly deteriorating removal efficiency of overs, and also provides limited operational flexibility.

Figure 4:
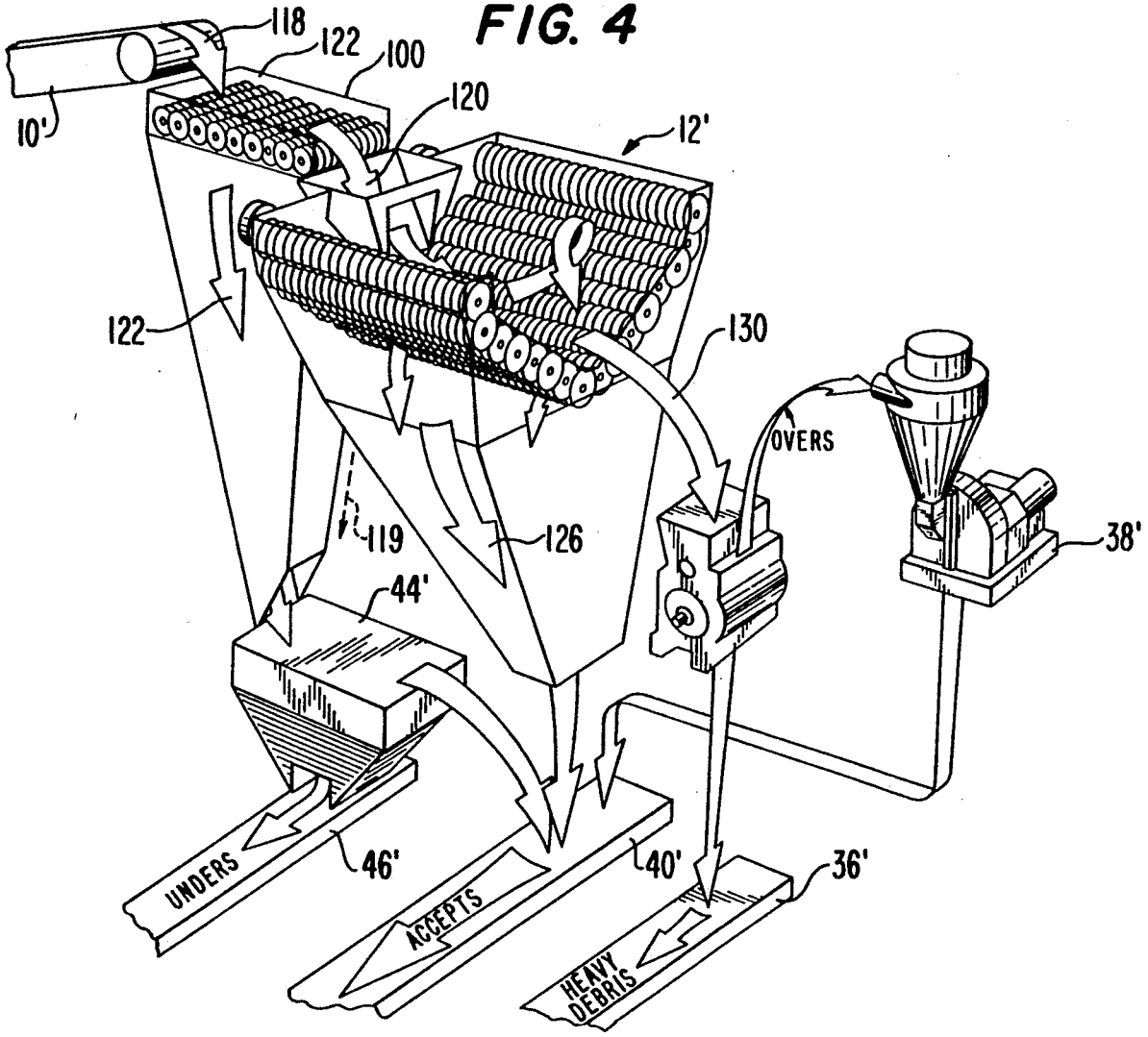
FIG. 4 illustrates a screening system for use in accordance with the present invention.

FIG. 4 shows a screening system in accordance with the present invention in which a horizontal disk screen 100 is provided upstream of the V-screen 12'. The chip infeed conveyor 10' provides a flow of chips 118 to the disk screen 100 with the flow over the disk screen 120 then passing to the V-screen, and the flow through the horizontal disk screen 122 passing to a screen 44' which will typically include a gyratory screen.

As shown by a comparison of the FIG. 2 and FIG. 4 systems, it is apparent that the system of FIG. 2 can be readily retrofitted to produce the FIG. 4 system by adding the horizontal disk screen and changing the through flow of the V-disk screen such that it flows to an accepts conveyor 40', rather than to the secondary screening unit 44. As is also readily apparent, the flow to the V-disk screen 120 (FIG. 4) does not include the entirety of the flow into the system, as compared to the FIG. 2 system in which the V-disk screen receives the entire (i.e. after scalping) incoming flow 18. Moreover, since the majority of the unders (including the pins and fines which tend to be more abrasive) are removed in the through flow 122, such that the V-screen is not subjected to the highly abrading smaller chips and particles. As with the FIG. 2 system, it is to be understood that a gross scalper would typically be provided upstream of the screening system shown in FIG. 4.

Since the flow to the V-screen, and particularly the proportion of unders in the flow to the V-screen, are greatly reduced, thereby reducing wear on the V-screen and slowing the deterioration in its removal efficiency with time. Even where the incoming flow 118 is greatly increased, as compared to that generally utilized in the conventional screening systems (18, FIG. 2), the flow 120 can still be maintained lower than that (18) of the conventional infeed. Lowering of the load to the V-screen will not only reduce wear, but also can allow for the selection of a V-screen having a reduced IFO, which will further increase the effectiveness of the V-screen in separating overs from the flow.

While in the system in accordance with the present invention, the entire incoming feed 118 is directed onto the horizontal disk screen, wear is not as great a problem on the flow management screen for a number of reasons. First, the horizontal disk screen in general is not as expensive as the V-screen. Secondly, while the wear tends to be greater at the front end 122 of the screen (as is the case with the V-screen), replacement of the shafts near the front end will eliminate wear for numerous worn disks. In contrast, with the V-screen, replacement of a shaft, a number of shafts, or an entire screen is required when only the front or upstream disks are worn, even though numerous downstream disks may be relatively wear free. Further, since the horizontal disk screen 100 is simply an initial flow separator, it is not as sensitive to wear, as the chips are further sized by the downstream screening stations 12', 44'. Perhaps most significantly, in accordance with the present invention, the horizontal disk screen is utilized to controlledly manage the flow, and control of the screen can be modified to accommodate for wear, such that substantially the same or similar performance can be attained despite wear of the horizontal disk screen. Since the horizontal disk screen serves to provide an initial flow separation and since it relieves wear on the V-screen, the horizontal disk screen can be referred to as a flow management screen or a relief screen.

Utilizing the flow management screen 100, the overall system can handle a greatly increased input feed rate at 118 as compared to the conventional system while attaining more consistent and controlled separation and sizing of the chips. The overflow 120 from the horizontal screen will include primarily overs and accepts, with a flow of accepts 126 passing through the V-screen for removal by the accepts conveyor 40', and the flow of overs 130 separated into heavy debris which is removed at 36', and oversized and overthick chips which are sent to the slicer 38' or other reduction device. The flow 122 passing through the flow management screen includes accepts and unders, with the accepts separated by the second screening station 44' and fed to the pulping digester by conveyor 40', and the unders removed as shown at 46'. Note that certain mills do not require removal of unders, and therefore, the flow 122 can be directed directly to the digester. Note also, if desired a small frontal portion of the flow through the V-screen can be peeled away and fed to the gyratory screen as indicated at 119. The frontal flow can sometimes have additional dislodged or loosened unders or fines, such that further screening by the gyratory screen benefits in reducing the amount of unders fed to the digester.

Applicant has come to two significant realizations in accordance with the present invention, which allows for controlled operation of the flow management screen 100 such that controlled and predictable performance of the system is attained. Firstly, Applicant has recognized that the proportional separation of the horizontal disk screen is related to the separation by sizing of the flows over (120) and through (122) the disk screen. Secondly, Applicant has recognized that by controlled operation of the flow management screen, the proportional separation of the incoming flow 118 into the output flows 120,122 can be controlled. Furthermore, Applicant has recognized that as the flow management screen wears, the desired flow separation can nevertheless be obtained, simply by modifying the control of the flow management screen to accommodate for the wear. Thus, the separation and sizing of the downstream screens 12',44' can be controlled, and the overall system performance can be more accurately controlled and predicted.

While the flow management screen has been illustrated and described as a horizontal disk screen in the preferred embodiment, it is to be understood that the present invention is not necessarily limited to horizontal disk screens as other screens are possible. For example, a spiral roll screen could be utilized, with the rotational speed of the spiral rolls controlled to vary the proportional separation of the incoming flow.

Figure 5A:
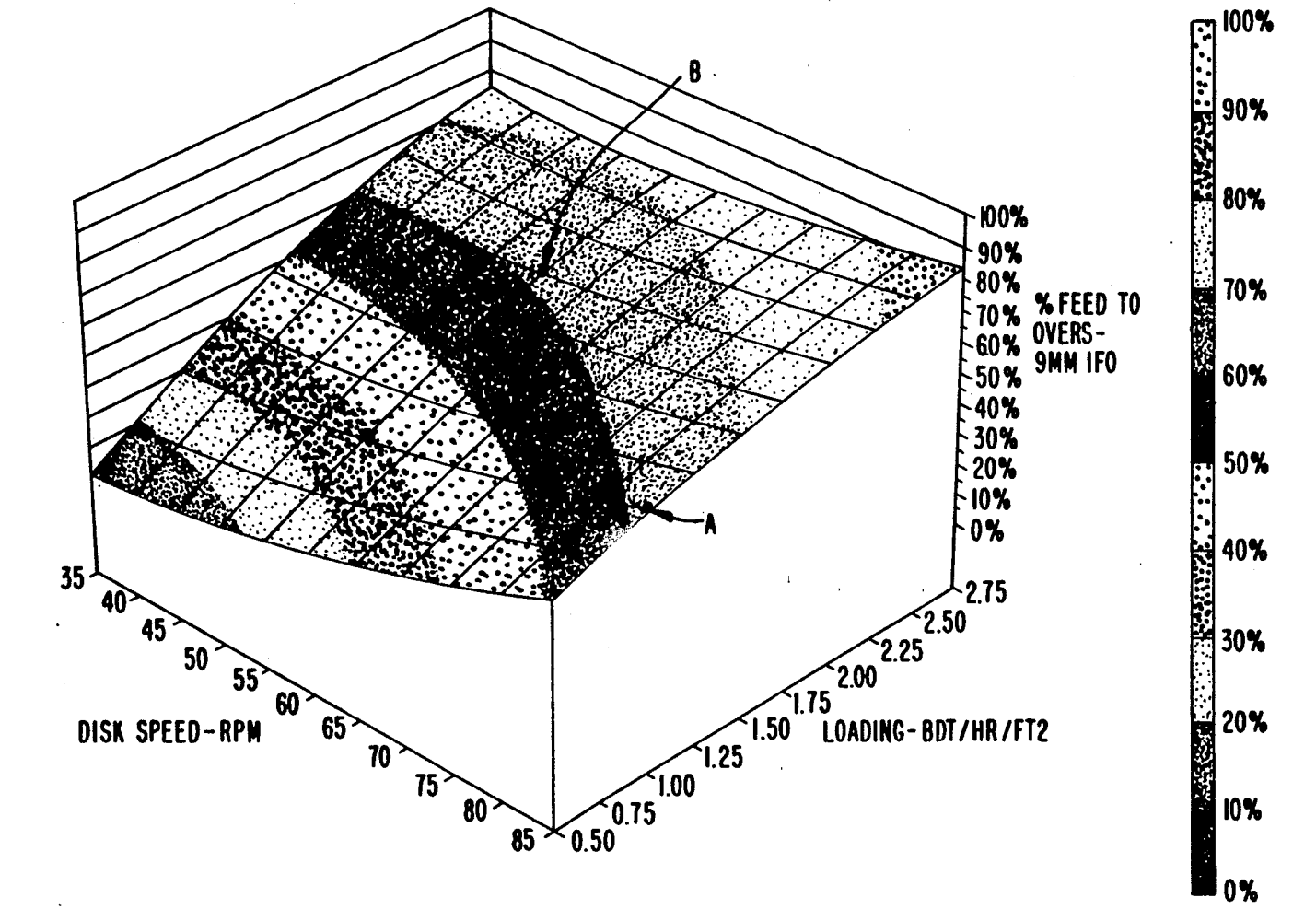
FIGS. 5A–5G are graphs of various performance characteristics of a flow management screen for various operating conditions.

FIGS. 5A–G show resulting plots of data obtained from numerous test samples for various operating conditions in which the rotational speed of the disk screen (rpm) and the loading of the disk screen (bone dry tons/hr/sq ft of screen area-BDT/hr/ft$^2$) were varied. Samples were then taken of the flow over the disk screen which would be passed to the V-screen (i.e., flow 120 of FIG. 4) and the flow passing through the screen (i.e., flow 122 of FIG. 4) and the volume as well as the sizing of the flows were determined, with sizing determined utilizing sample screening devices similar to that shown in FIG. 1. FIG. 5A demonstrates the relationship between disk speed, loading and the percentage of the infeed (118) which passes over the disk screen to the V-screen (flow 120).

As demonstrated in FIG. 5A, as the disk speed increases for a given loading, the proportional separation of the incoming flow changes, such that a greater proportion or percentage of the infeed is fed to the V-screen. In addition, as the loading increases, the proportion of chips fed to the V-screen also increases. Most significantly, the FIG. 5A plot demonstrates that the proportional separation can be controlled to be consistent or substantially similar over a variety of loadings or flow rates. For example, if it is desired to feed approximately 60% of the infeed to the V-screen, and the loading is 1.00 BDT/hr./ft$^2$, a disk speed of 85 rpm can be selected as shown at point A. If, however, the loading is increased by 100% to 2.00 BDT/hr/ft$^2$, substantially the same separation can be achieved simply by decreasing the rotational speed to 55 rpm as shown by point B. Thus, a desired proportional separation of the incoming feed can be achieved despite a wide variation in the loading, by controlling the rotational speed of the horizontal disk screen. Note that the term overs in FIG. 5A is a shorthand for chips that flow over the horizontal disk screen, and is not to be confused with the use of the term "overs" in the sense of describing chips which are oversized or overthick.

Figure 5B:
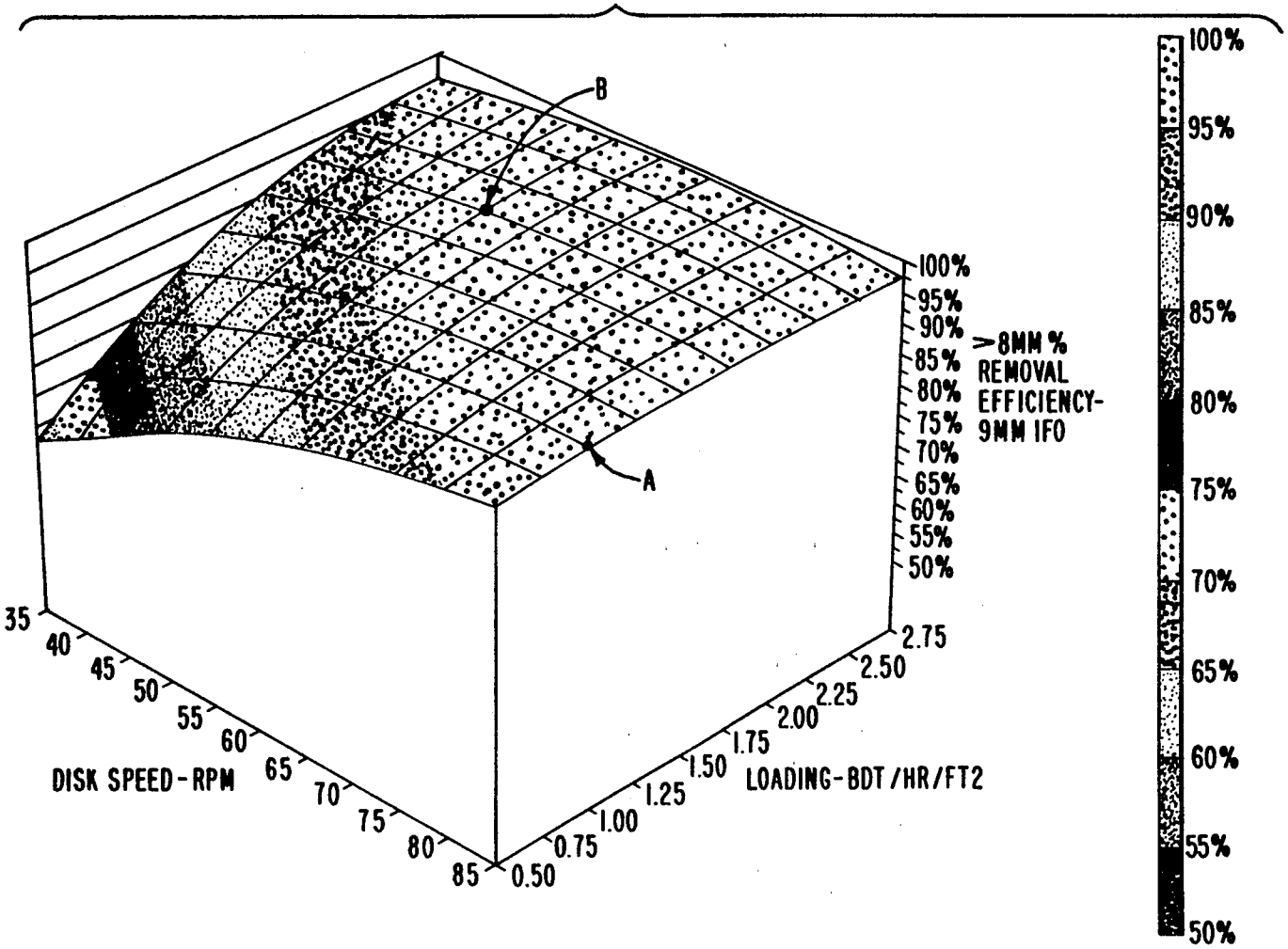

FIG. 5B illustrates the removal efficiency of "overs" (oversized and overthick), as measured by the percentage of chips greater than 8 mm in thickness which are removed from the incoming flow and passed to the V-screen. Thus, the dependence of removal efficiency on disk speed and loading is demonstrated. This parameter is extremely important since it is necessary to maintain a high removal efficiency of the oversized and overthick chips for handling by the V-screen, as the oversized and overthick which passes through the horizontal disk screen would generally pass to the digester, since they would not be separated from the accepts by the secondary or unders screening unit (44', FIG. 4). As demonstrated by the extremely large area on the right portion of the plot, very high removal efficiencies can be obtained over a wide range of loadings. Thus, utilizing the datum points referred to in FIG. 5A, a removal efficiency in excess of 96% can be obtained at a loading level of 1.00 BDT/hr/ft$^2$, with a disk speed of 85 rpm. The higher removal efficiency can be maintained where the loading is increased to 2.00 BDT/hr,/ft$^2$, with the disk speed reduced to 55 rpm as shown by point B.

Figure 5C:
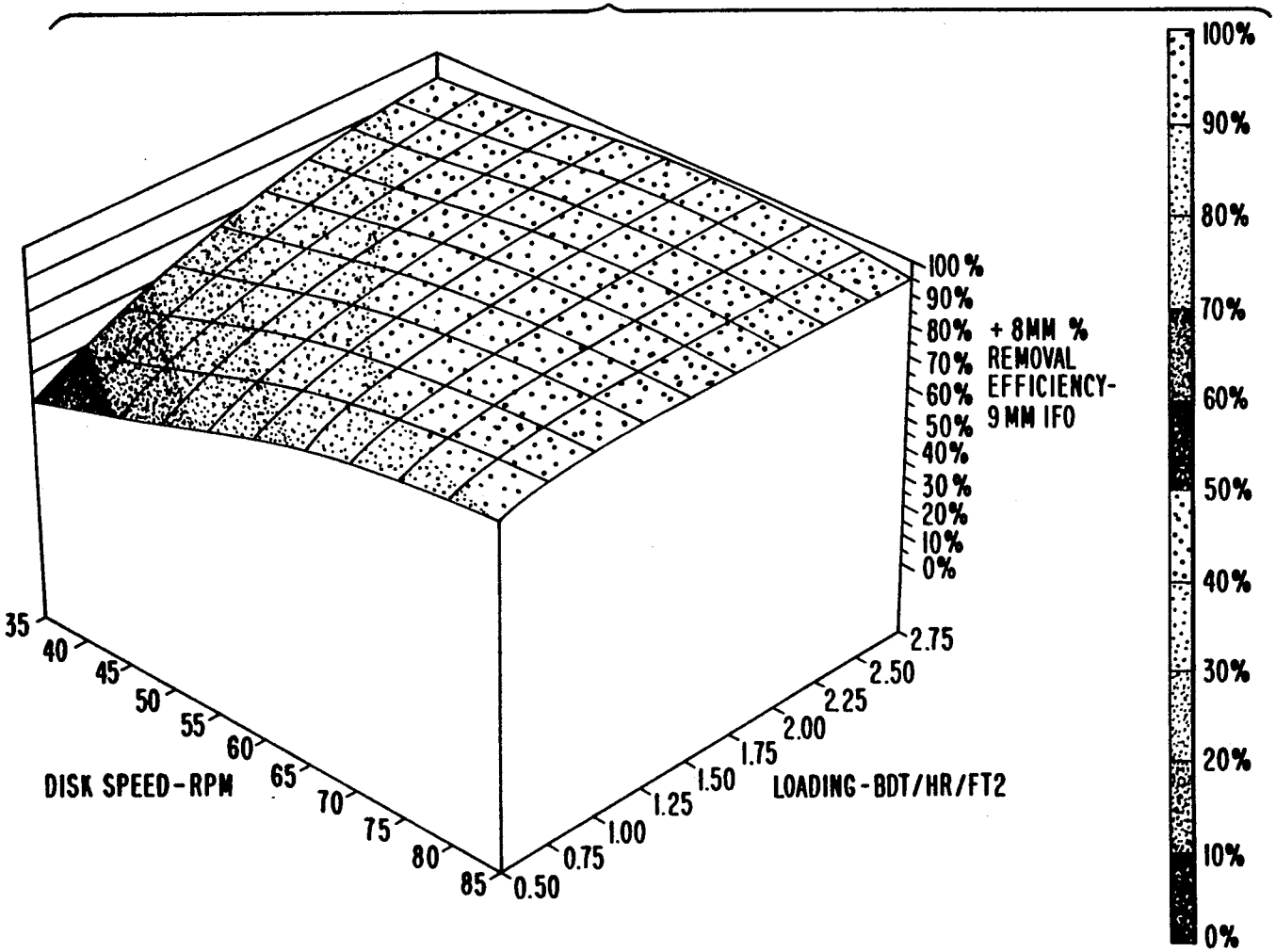
Figure 5D:
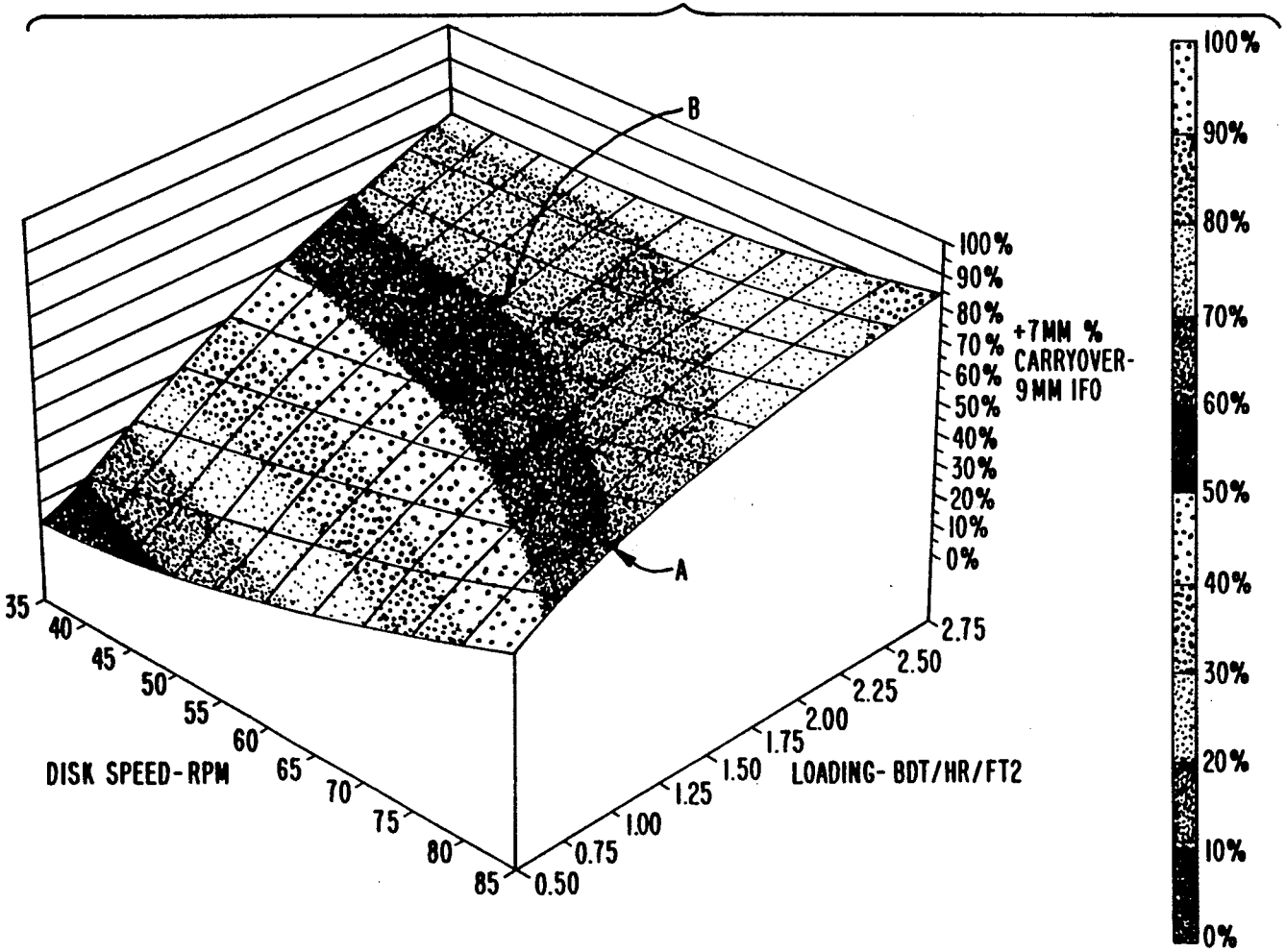

FIG. 5C demonstrates information relating to the discrete removal of chips exceeding 8 mm (i.e., those which are less than 10 mm, but greater than 8 mm). The term "discrete"+8 mm is utilized to indicate chips within a size range, i.e. greater than 8 mm and less than 10 mm, while "cumulative">8 mm would be utilized to indicate all chips greater than 8 mm. FIG. 5D plots the proportion of "accepts" (i.e., those chips which are most desirable for feeding to the digester—those which fall through the 8 mm slot screen, but which are retained by the 7 mm round hole screen in the sampling screens). As shown by the same points A and B, the percentage of the accepts carried over to the V-screen is very similar despite a 100% increase in the incoming load.

Figure 5E:
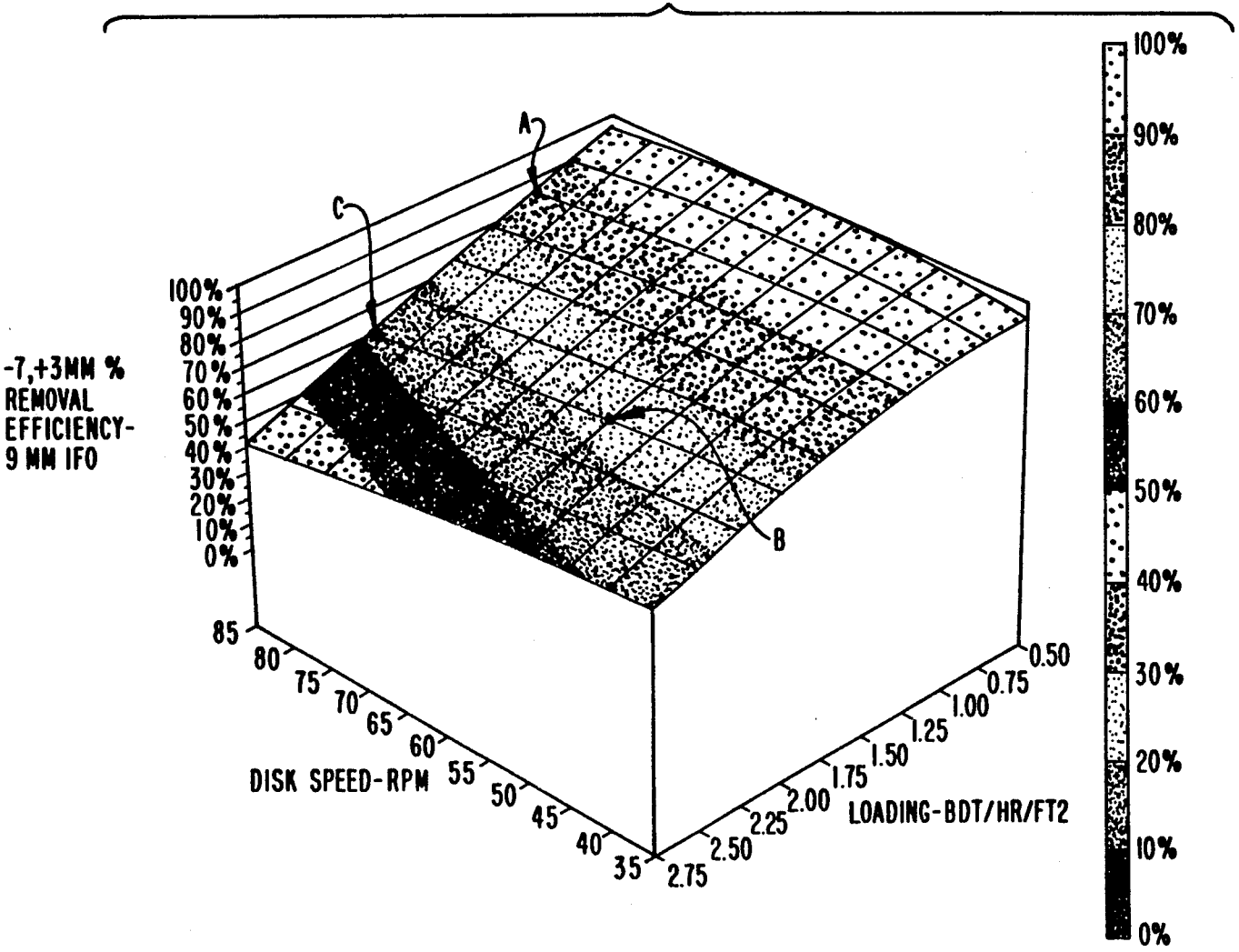
Figure 5F:
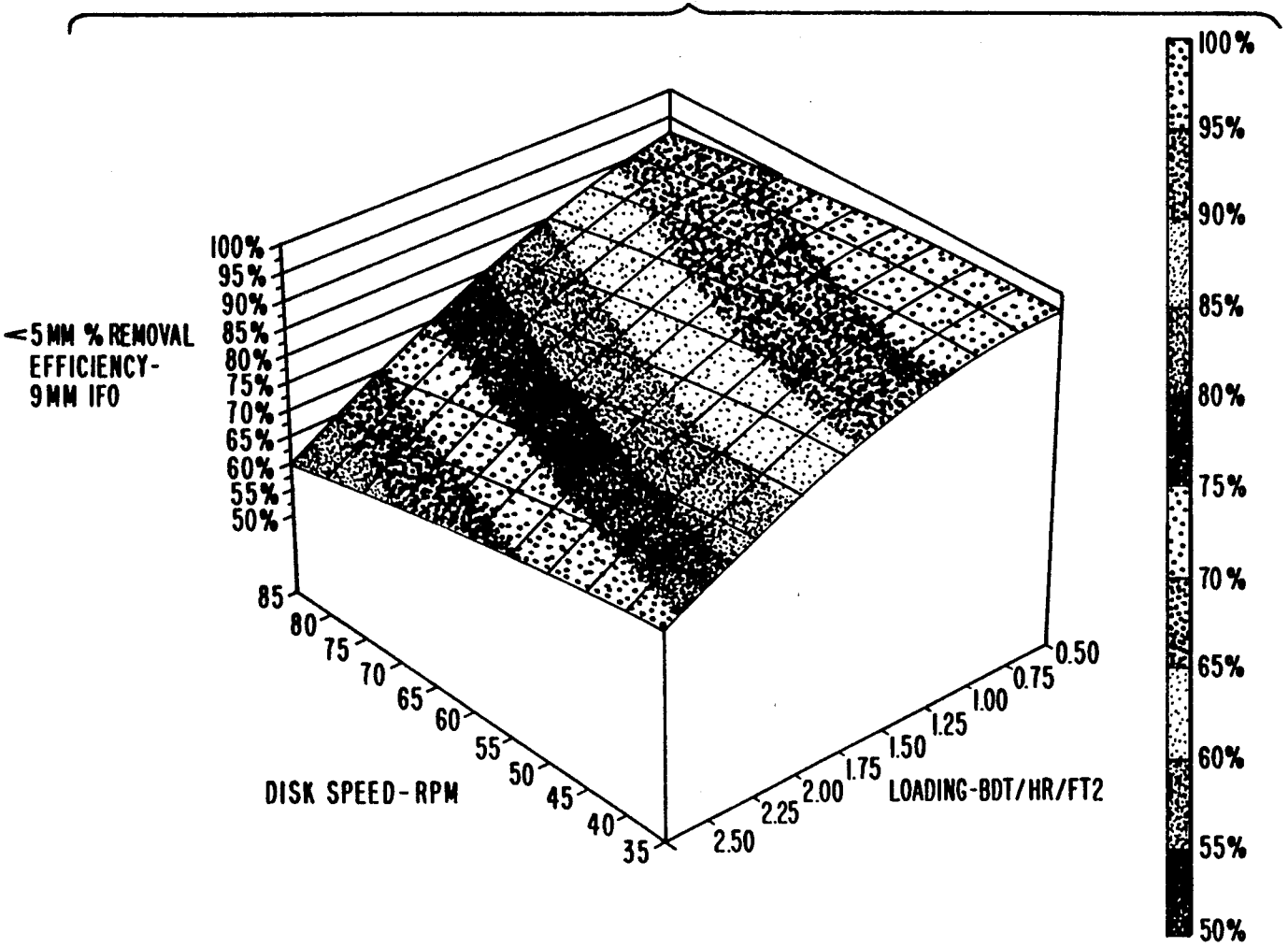
Figure 5G:
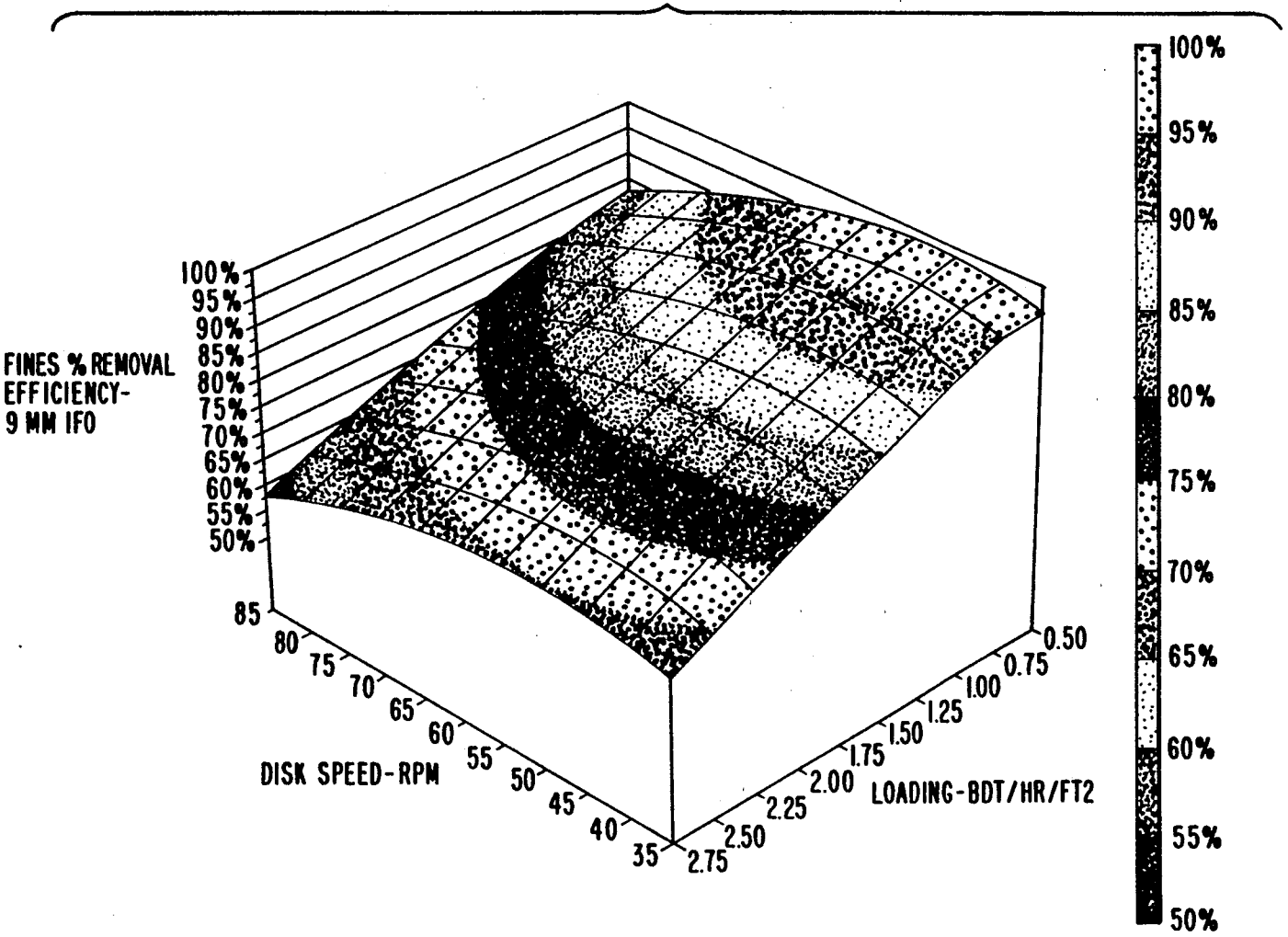

FIG. 5E plots the removal efficiency of pin chips (less than 7 mm, but greater than 3 mm), for various disk speeds and loadings, with the removal efficiency indicating the percentage of the pins of the incoming flow which pass through the horizontal disk screen into flow 122 of FIG. 4. While the removal efficiency of pins is reduced as the loading is increased from point A to point B (as would be expected where a greater flow volume is passing over the screen) note that the removal efficiency of pins is nevertheless superior when compared to the situation where the loading is increased, without modifying the rotational speed of the disk screen as demonstrated by point C. FIG. 5F plots the cumulative removal of small chips (less than 5 mm) as a percentage of the small fraction from the incoming flow which is passed through the flow management disk screen (into flow 122). FIG. 5G plots the removal efficiency of fines (less than 3 mm).

The data of FIGS. 5A–G was obtained utilizing a 9 mm IFO horizontal disk screen. It is apparent that the proportional flow separation and resulting sizing separation can be predicted for various loadings and disk screen rotational speeds. Similar data was obtained for a variety of horizontal disk screen IFOs, to allow prediction of the performance of the flow management screen for various screen rotational speeds, loadings, and IFOs.

Utilizing the empirical data, for a given series of conditions, the resulting performance of the flow management disk screen can be predicted. The tables in the Appendix demonstrate a simulation of flow management screen performance for a variety of input conditions. In cases 1–6, a constant IFO and rotational speed were utilized, with the loadings varied from 0.84–2.11 BDT/hr/ft$^2$. The particle size class in the left portion of the tables refers to discrete sizings, for example, the +8 mm refers to particles which are greater than 8 mm but less than the 10 mm. The cumulative fractions on the right portion of the tables refer to all particles within the cumulative range, for example, the >8 mm refers to all chips greater than 8 mm, which includes the +8 mm and +10 mm. Cases 7–9 simulate disk screen performance for varying loadings and disk speeds in support of a simulation and programmed logic control system.

As the simulated data demonstrates, for a given rotational speed, as the loading increases, and the percentage mass fraction fed to the V-screen increases, the removal efficiency of the overthick also increases (see e.g., the removal efficiency of 90.1% of >8 mm in case 1, as compared to 97.7% removal of >8 mm in case 6. A comparison of the case 7 vs. case 8 data demonstrates that a substantially constant overthick removal efficiency can be obtained despite a large increase in the loading.

In the case 7 data, with a 90 BDT per hour loading, and 84.4 rpm disk speed, a 97.1% removal efficiency of >8 mm was obtained. Substantially the same removal efficiency could also be obtained despite an increase in the infeed to 150 BDT/hr, by reducing the disk speed to 64.8 rpm, resulting in a 97.0% removal efficiency of >8 mm. Thus, in accordance with the present invention, Applicant has realized that for a variety of feed rates, the performance of the disk screen can be predicted and controlled by varying the rotational speed of the disk screen. The speed of the disk screen varies the proportional separation of the incoming feed of the flow management screen, and allows for a determination of the separation as to size of the proportional flows.

Where the incoming feed rate is known, the flow management screen can thus be controlled in response, to achieve a desired proportional separation and a desired sizing separation. For example, with reference to the Case 7 and 8 data, if it is desired to operate the flow management screen such that the removal efficiency of the flow to the V-screen for greater than 8 mm is at least 97%, a signal to a control system indicating the infeed is 90 BDT/hr, would cause the control system to operate the disk screen at approximately 84.4 rpm. When a signal indicates that the infeed has increased to 150 BDT/hr, the control system would reduce the speed to approximately 64.8 rpm. The control system can take the form of a methodical relationship modeled from the empirical data, or it may take the form of a look-up chart within the control system, such that the output control signal for the disk speed is selected corresponding to the infeed rate to provide the desired performance.

Note that the tabulated data of the Appendix refers to a two-line system, i.e., in which a hopper or conveyor feeds two of the FIG. 4 systems (as referred to by the number of screens in the heading of the tables). The same proportional separation and removal efficiencies would be obtained for a single screen system (i.e., having one flow management screen), where the incoming loading is halved.

In accordance with another aspect of the present invention, Applicant has recognized that accommodation can be made for wear to allow prediction of the flow management screen performance despite wear. As a screen wears, the performance will vary from the predicted controlled performance. By taking test samples for a given loading rate and disk speed, after wear, it can be determined how the wear has varied the performance. For example, after an 8.0 mm IFO disk screen has been in operation for a period of time, the performance will vary from that which is expected. Utilizing data simulation or modeling, or with reference to empirical data, it can be determined that the screen is actually acting as if it had a different IFO, for example, an 8.5 mm IFO, by selecting an IFO which would produce data in terms of the product composition of the through flow (which most typically would be the flow sampled), corresponding to the actual test data (i.e., for the worn 8.0 mm IFO screen) for the given loading and disk speed.

Thus, the disk speed for the worn 8.0 mm screen can be adjusted to produce the desired performance. This may take a variety of forms, depending upon the selected control system. For example, where the control system includes data for controlling a screen of a certain IFO, the adjustment for wear may be in the form of a percentage adjustment, which roughly accommodates for the wear by increasing the speed a certain percentage depending upon the amount of wear. Alternatively, the control system may contain additional sets of IFO data or look-up charts may be utilized for the particular IFO which it is determined that the worn screen is most similar to (this may also involve interpolation between look-up tables, for example if the programmed logic includes 8.0 and 9.0 IFOs, and the worn 8.0 screen is determined to be acting as if the IFO were 8.5, an interpolation can be performed between the speed obtained from the 8.0 table and the 9.0 table). In addition, where experience makes the degree or rapidity of wear predictable, an adjustment may be made which requires the operator to adjust according to the age or time in the service of the screen. For example, the programmed logic control may include input settings for new, slight wear, moderate wear or extreme wear, with the operator changing the setting depending on the time in service of the screen. The setting will then cause the programmed logic to modify the disk screen speed control, by either the percentage adjustment or the use of additional look-up tables as discussed above.

Figure 6:
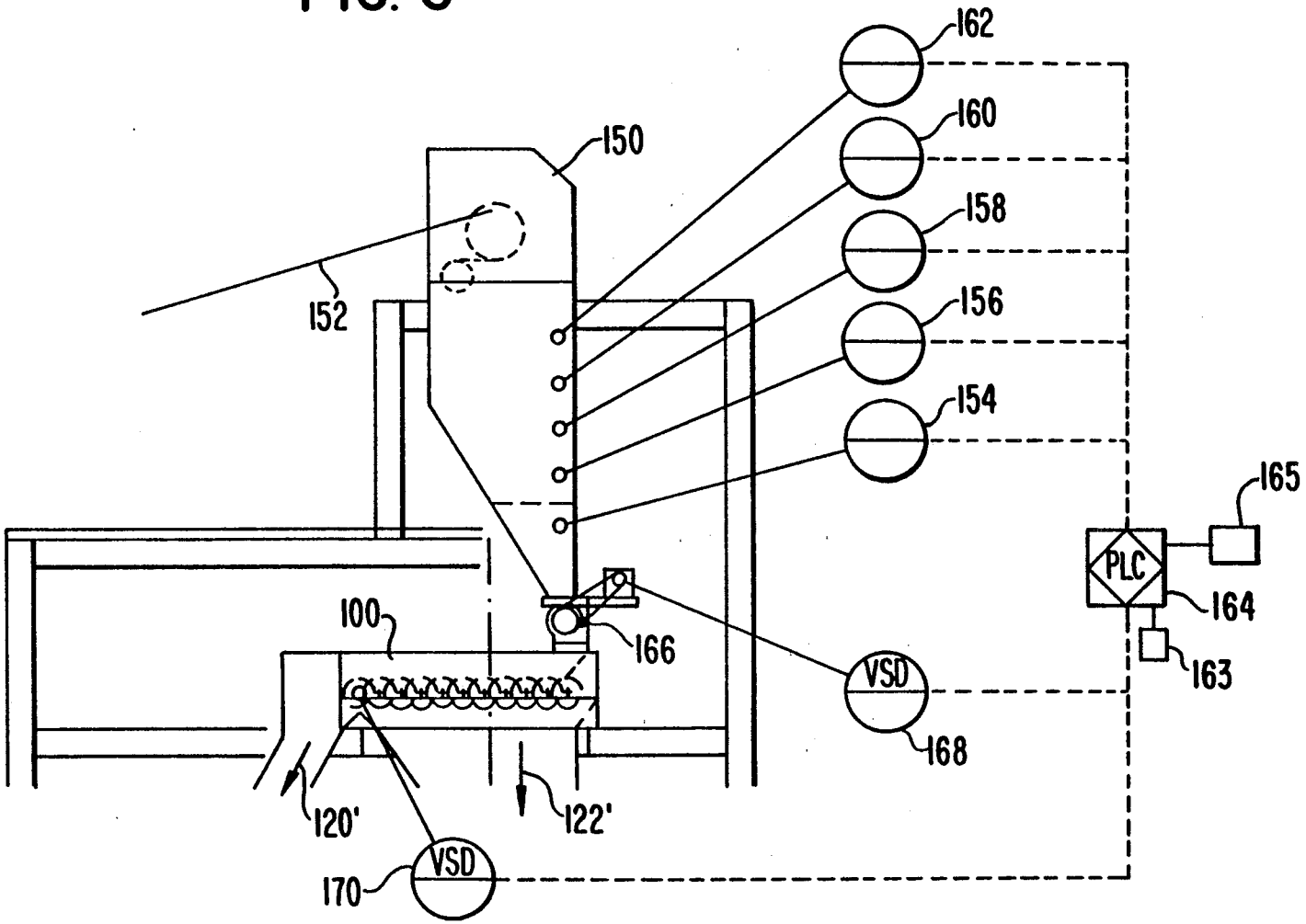
FIGS. 6–8 show different embodiments for controlled flow management in accordance with the present invention.
Figure 7:
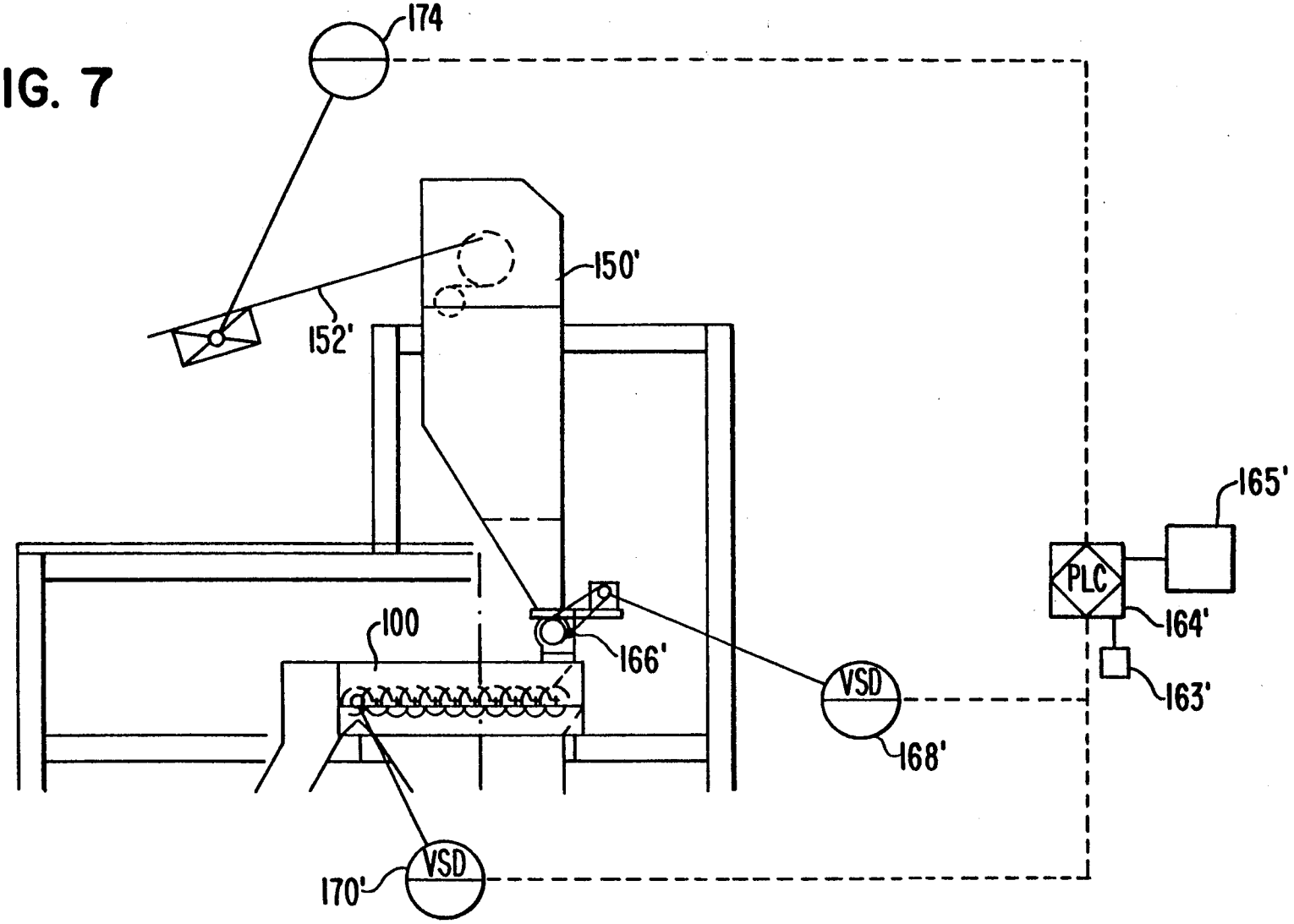
Figure 8:
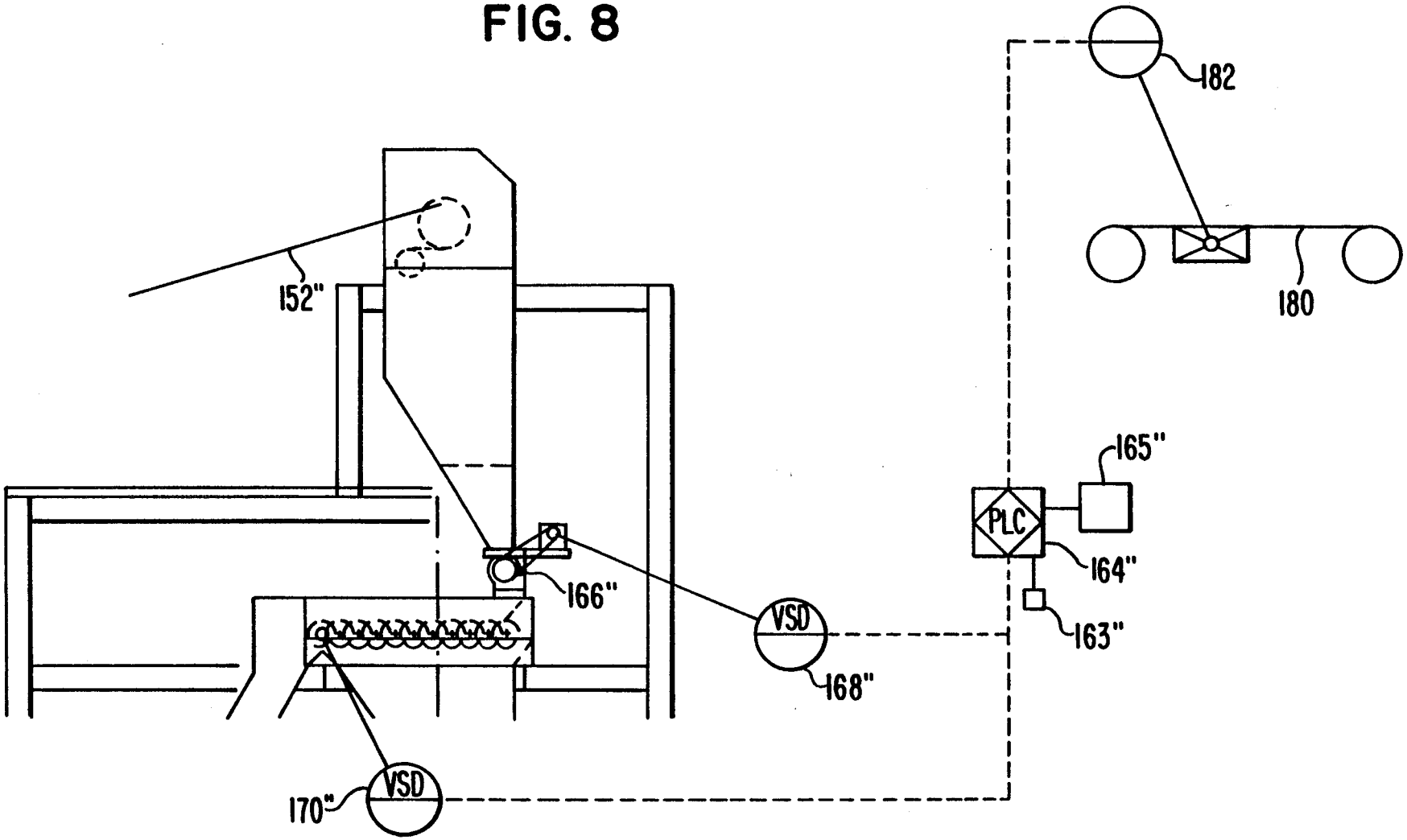

Turning now to FIGS. 6–8, various arrangements for controlled flow management will be described. FIG. 6 shows control of the wood chip flow in the flow management screen depending upon the level of wood chips in a hopper. The chips can be fed directly from the hopper to the flow management screen, or may be fed to the flow management screen by a conveyor as shown at 101 of FIG. 4. The hopper 150 is utilized to provide continuous operation of the chip screening system, despite variations in feeding from the conveyor 152 which supplies wood chips to the hopper. To ensure that the hopper does not overflow and also to ensure that the hopper does not run empty, a series of level sensors 154,156,158,160,162 are provided which act to control the feed from the hopper. In particular, as the level in the hopper increases, the feed from the hopper is increased, and as the level decreases, the flow from the hopper is correspondingly decreased.

The signals indicating the chip level in the hopper are fed to a programmed logic control unit 164, which in turn provides a signal to control the feed rate from the hopper. The chips are fed from the hopper by a star feed wheel 166, or other known means, with a variable speed drive 168 provided which receives the control signal from the control unit 164, and controls the feed from the hopper accordingly. The programmed logic control unit also provides a signal to a variable speed drive 170 to control the performance of the screen as to the proportions of the flow which flows over (120)' and through (122') the flow management screen. As would be recognized by one skilled in the art, depending upon the control logic, the signal for controlling the flow management screen may be produced in response to the signal controlling the hopper feed, or directly in response to the level signals (or other feed rate determining signals as discussed hereinafter). Since both the signals controlling feed as well as signals which control feed are indications of the resulting feed to the flow management screen, they all may be considered signals indicative of the feed rate to the horizontal disk screen. If desired, other sensors/signals may be utilized to indicate feed to the flow management screen, for example optical or weight sensors just upstream of the screen. Note that while five level sensors are shown in the FIG. 6 embodiment, the number of sensors and location may be varied. An additional input 165 is provided to allow the operator to input an indication of wear of the screen, to correspondingly modify the speed control of the flow management screen 100. As noted earlier, the wear adjustment may be in the form of an input for a percentage adjustment; a time in service or wear appraisal; or an IFO modification.

FIG. 7 shows the use of a weigh meter 174 which determines the feed rate of chips from the conveyor 152' to the hopper 150', with the logic control 164' controlling the drive 168' of the feed 166' depending on the infeed rate. The logic control may vary the feed from the hopper based upon the infeed to the hopper. Since the feed to the hopper may fluctuate, preferably the feed to the screen from star feed wheel 166' will be controlled based upon the volume within the hopper 150'. This volume can be determined utilizing a memory in the control logic which (1) stores a signal indicative of the volume in the hopper; (2) adds volume based upon the feed from conveyor 152'; (3) subtracts volume based upon the feed from the hopper at 166'; and (4) controls the feed rate at 166' based upon the volume calculation. The variable speed drive 170' of the flow management screen 100 is in turn controlled based upon the feed rate from the hopper to the flow management screen. As in the FIG. 6 embodiment, an additional input 165' can be provided to accommodate for wear of the flow management screen.

In yet another modification, as shown in FIG. 8, the feed from the hopper at 166'' can be controlled based upon the feed from the chip storage, or the feed into the screening room. As in the FIG. 7 embodiment, the feed rate on a supply conveyor 180 is determined by a weigh meter 182. The feed from the hopper is controlled by the logic control 164'' and variable speed drive 168'' to accommodate for variations in the supply feed. The variable speed drive 170'' is correspondingly controlled by the logic control 164''. The arrangement of FIG. 8 is similar to that of FIG. 7, however has the further advantage in that the feed rate information is provided even further in advance. Thus, more information can be provided to the logic control as to the flow rate and volume of chips in the systems, such that the feed from the hopper at 166'' can be more evenly controlled. Other controlling methods and systems may also be utilized as would be recognized by one skilled in the art.

As shown at 163, 163' and 163'' of FIGS. 6–8, an additional control modification may be provided to vary the control for differing types of wood chips. For example if softwood or hardwood are being sized, it may be considered acceptable to allow larger chips to be fed to the digester, since the digester chemicals will penetrate more deeply, and thus the flow management screen can operate at higher speeds. Thus, the operator can input a particular species or hardness of chips being sized, with the control of the flow management screen modified accordingly. The modification may take the form of a percentage adjustment, or the selection of different maps or look-up charts for different chip types.

INDUSTRIAL APPLICABILITY

The use of controlled flow management of wood chip feeding and sizing can be utilized both in new systems and in retrofitting existing systems. By controlling the proportional separation at an initial flow management screen, more accurate and/or predictable control of the volume and composition of flow to downstream screen(s) is achieved. Since the flow management screen divides the flow prior to reaching the downstream screens, wear on the downstream screens is reduced. In addition, since operation/control of the flow management screen can be modified to accommodate for wear, its useful life can be prolonged while maintaining a high level of effectiveness in controlling the chip flow to the downstream screens with significant process flexibilities.

APPENDIX

FLOW MANAGEMENT DISK SCREEN
Loading Sensitivity Table #1

| | | | |
|---|---|---|---|
| | | Material: AVERAGE HARDWOOD | Equipment: HORIZONTAL DISC |
| # of Screens | 2 | | Disk IFO: 9.0 mm |
| Effective Width: | 5.0 ft | Screen Size: 5.0 × 9.5 ft | Disk RPM: 60.0 RPM |
| Effective Length: | 9.5 ft | Effective Area: 95.0 square ft | Peripheral Speed: 263.1 ft/min |

| | | Particle Size Class | | | | | | Mass | Cumulative Fractions | | |
|---|---|---|---|---|---|---|---|---|---|---|---|
| | | +10 mm | +8 mm | +7 mm | +5 mm | +3 mm | Pan | Fraction | >8 mm | −7, +3 mm | <5 mm |
| Feed Characterization | Feed % | 5.0% | 7.5% | 80.7% | 3.1% | 3.0% | 0.7% | | 12.5% | 6.1% | 3.7% |
| CASE #1 | Feed Mass | 4.00 | 6.00 | 64.56 | 2.48 | 2.40 | 0.56 | | | | |
| Mass In: 80 | Flow Over Screen | | | | | | | | | | |
| BD tons/hour | Mass | 3.85 | 5.16 | 20.88 | 0.12 | 0.07 | 0.03 | 37.6% | | | |
| | % of Flow Over | 12.8% | 17.1% | 69.3% | 0.4% | 0.2% | 0.1% | | 29.9% | 0.6% | 0.3% |
| Loading: 0.84 | % Removal Eff. | 96.3% | 86.0% | 32.3% | 4.9% | 2.7% | 6.0% | | 90.1% | 3.8% | 3.4% |

APPENDIX-continued

| | | | | | | | | | | | |
|---|---|---|---|---|---|---|---|---|---|---|---|
| tons/hr/ft 2 | | | | | | | | | | | |
| | Flow Through Screen | | | | | | | | | | |
| | Mass | 0.15 | 0.84 | 43.68 | 2.36 | 2.33 | 0.53 | 62.4% | | | |
| | % of Flow Through | 0.3% | 1.7% | 87.6% | 4.7% | 4.7% | 1.1% | | 2.0% | 9.4% | 5.7% |
| | % Removal Eff. | 3.7% | 14.0% | 67.7% | 95.1% | 97.3% | 94.0% | | 9.9% | 96.2% | 96.6% |
| CASE #2 | Feed Mass | 6.00 | 9.00 | 96.84 | 3.72 | 3.60 | 0.84 | | | | |
| Mass In: 120 | Flow Over Screen | | | | | | | | | | |
| BD tons/hour | Mass | 5.87 | 8.27 | 44.68 | 0.49 | 0.25 | 0.09 | 49.7% | | | |
| | % of Flow Over | 9.8% | 13.9% | 74.9% | 0.8% | 0.4% | 0.2% | | 23.7% | 1.2% | 0.6% |
| Loading: 1.26 | % Removal Eff. | 97.8% | 91.9% | 46.1% | 13.3% | 6.9% | 10.8% | | 94.2% | 10.2% | 7.7% |
| tons/hr/ft 2 | | | | | | | | | | | |
| | Flow Through Screen | | | | | | | | | | |
| | Mass | 0.13 | 0.73 | 52.16 | 3.23 | 3.35 | 0.75 | 50.3% | | | |
| | % of Flow Through | 0.2% | 1.2% | 86.4% | 5.3% | 5.6% | 1.2% | | 1.4% | 10.9% | 6.8% |
| | % Removal Eff. | 2.2% | 8.1% | 53.9% | 86.7% | 93.1% | 89.2% | | 5.8% | 89.8% | 92.3% |
| CASE #3 | Feed Mass | 7.50 | 11.25 | 121.05 | 4.65 | 4.50 | 1.05 | | | | |
| Mass In: 150 | Flow Over Screen | | | | | | | | | | |
| BD tons/hour | Mass | 7.38 | 10.61 | 65.20 | 0.96 | 0.49 | 0.16 | 56.5% | | | |
| | % of Flow Over | 8.7% | 12.5% | 76.9% | 1.1% | 0.6% | 0.2% | | 21.2% | 1.7% | 0.8% |
| Loading: 1.58 | % Removal Eff. | 98.5% | 94.3% | 53.9% | 20.6% | 10.8% | 14.9% | | 96.0% | 15.8% | 11.6% |
| tons/hr/ft 2 | | | | | | | | | | | |
| | Flow Through Screen | | | | | | | | | | |
| | Mass | 0.12 | 0.64 | 55.85 | 3.69 | 4.01 | 0.89 | 43.5% | | | |
| | % of Flow Through | 0.2% | 1.0% | 85.7% | 5.7% | 6.2% | 1.4% | | 1.2% | 11.8% | 7.5% |
| | % Removal Eff. | 1.5% | 5.7% | 46.1% | 79.4% | 89.2% | 85.1% | | 4.0% | 84.2% | 88.4% |

FLOW MANAGEMENT DISK SCREEN
Loading Sensitivity Table #2

| | | | |
|---|---|---|---|
| # of Screens | 2 | Material: AVERAGE HARDWOOD | Equipment: HORIZONTAL DISC |
| Effective Width: | 5.0 ft | Screen Size: 5.0 × 9.5 ft | Disk IFO: 9.0 mm |
| Effective Length: | 9.5 ft | Effective Area: 95.0 square ft | Disk RPM: 60.0 RPM |
| | | | Peripheral Speed: 263.1 ft/min |

| | | Particle Size Class | | | | | | Mass | Cumulative Fractions | | |
|---|---|---|---|---|---|---|---|---|---|---|---|
| | | +10 mm | +8 mm | +7 mm | +5 mm | +3 mm | Pan | Fraction | >8 mm | −7, +3 mm | <5 mm |
| Feed Characterization | Feed % | 5.0% | 7.5% | 80.7% | 3.1% | 3.0% | 0.7% | | 12.5% | 6.1% | 3.7% |
| CASE #4 | Feed Mass | 8.00 | 12.00 | 129.12 | 4.96 | 4.80 | 1.12 | | | | |
| Mass In: 160 | Flow Over Screen | | | | | | | | | | |
| BD tons/hour | Mass | 7.89 | 11.39 | 72.41 | 1.15 | 0.59 | 0.18 | 58.5% | | | |
| | % of Flow Over | 8.4% | 12.2% | 77.4% | 1.2% | 0.6% | 0.2% | | 20.6% | 1.9% | 0.8% |
| Loading: 1.68 | % Removal Eff. | 98.6% | 95.0% | 56.1% | 23.2% | 12.2% | 16.3% | | 96.4% | 17.8% | 13.0% |
| tons/hr/ft 2 | | | | | | | | | | | |
| | Flow Through Screen | | | | | | | | | | |
| | Mass | 0.10 | 0.56 | 57.70 | 3.96 | 4.49 | 1.00 | 38.7% | | | |
| | % of Flow Through | 0.2% | 0.8% | 85.1% | 5.8% | 6.6% | 1.5% | | 1.0% | 12.5% | 8.1% |
| | % Removal Eff. | 1.2% | 4.3% | 40.9% | 73.0% | 85.5% | 81.6% | | 3.0% | 79.1% | 84.7% |
| CASE #5 | Feed Mass | 8.75 | 13.13 | 141.23 | 5.43 | 5.25 | 1.23 | | | | |
| Mass In: 175 | Flow Over Screen | | | | | | | | | | |
| BD tons/hour | Mass | 8.65 | 12.56 | 83.52 | 1.47 | 0.76 | 0.22 | 61.3% | | | |
| | % of Flow Over | 8.1% | 11.7% | 77.9% | 1.4% | 0.7% | 0.2% | | 19.8% | 2.1% | 0.9% |
| Loading: 1.84 | % Removal Eff. | 98.8% | 95.7% | 59.1% | 27.0% | 14.5% | 18.4% | | 97.0% | 20.9% | 15.3% |
| tons/hr/ft 2 | | | | | | | | | | | |
| | Flow Through Screen | | | | | | | | | | |
| | Mass | 0.10 | 0.56 | 57.70 | 3.96 | 4.49 | 1.00 | 38.7% | | | |
| | % of Flow Through | 0.2% | 0.8% | 85.1% | 5.8% | 6.6% | 1.5% | | 1.0% | 12.5% | 8.1% |
| | % Removal Eff. | 1.2% | 4.3% | 40.9% | 73.0% | 85.5% | 81.6% | | 3.0% | 79.1% | 84.7% |
| CASE #6 | Feed Mass | 10.00 | 15.00 | 161.40 | 6.20 | 6.00 | 1.40 | | | | |
| Mass In: 200 | Flow Over Screen | | | | | | | | | | |
| BD tons/hour | Mass | 9.91 | 14.51 | 102.74 | 2.09 | 1.12 | 0.31 | 65.3% | | | |
| | % of Flow Over | 7.6% | 11.1% | 78.6% | 1.6% | 0.9% | 0.2% | | 18.7% | 2.5% | 1.1% |
| Loading: 2.11 | % Removal Eff. | 99.1% | 96.7% | 63.7% | 33.7% | 18.7% | 22.0% | | 97.7% | 26.3% | 19.4% |
| tons/hr/ft 2 | | | | | | | | | | | |
| | Flow Through Screen | | | | | | | | | | |
| | Mass | 0.09 | 0.49 | 58.66 | 4.11 | 4.88 | 1.09 | 34.7% | | | |
| | % of Flow Through | 0.1% | 0.7% | 84.6% | 5.9% | 7.0% | 1.6% | | 0.8% | 13.0% | 8.6% |
| | % Removal Eff. | 0.9% | 3.3% | 36.3% | 66.3% | 81.3% | 78.0% | | 2.3% | 73.7% | 80.6% |

FLOW MANAGEMENT DISK SCREEN
RPM vs Mass Split Optimizer
Data From: COMMERICAL CONFIRMATION # of Screens: 2 Disk IFO: 9.0 mm -continued

| Material: AVERAGE HARDWOOD<br>Equipment: HORIZONTAL DISC SCREEN | | Effective Width: 5.0 ft<br>Effective Length: 9.5 ft | | | | | | Physical Screen Size: 5.0 × 9.5 ft<br>Effective Area: 95.0 square ft | | | |
|---|---|---|---|---|---|---|---|---|---|---|---|
| Target<br>% Feed to Overs: 60% | | Particle Size Class | | | | | | Mass | Cumulative Fractions | | |
| | | +10 mm | +8 mm | +7 mm | +5 mm | +3 mm | Pan | Fraction | >8 mm | −7, +3 mm | <5 mm |
| Feed Characterization | Feed % | 5.0% | 7.5% | 80.7% | 3.1% | 3.0% | 0.7% | | 12.5% | 6.1% | 3.7% |
| CASE #7 | Feed Mass | 4.50 | 6.75 | 72.63 | 2.79 | 2.70 | 0.63 | | | | |
| Mass In: 90 | Flow Over Screen | | | | | | | | | | |
| BD tons/hour | Mass | 4.49 | 6.43 | 42.42 | 0.41 | 0.22 | 0.12 | 60.1% | | | |
| | % of Flow Over | 8.3% | 11.9% | 78.4% | 0.8% | 0.4% | 0.2% | | 20.2% | 1.2% | 0.6% |
| Loading: 0.95 tons/hr/ft 2 | % Removal Eff. | 99.8% | 95.3% | 58.4% | 14.9% | 8.1% | 19.5% | | 97.1% | 11.5% | 10.3% |
| | Flow Through Screen | | | | | | | | | | |
| Disk RPM: 84.4 | Mass | 0.01 | 0.32 | 30.21 | 2.38 | 2.48 | 0.51 | 39.9% | | | |
| Speed: 370.3 | % of Flow Through | 0.0% | 0.5% | 45.5% | 3.6% | 3.7% | 0.8% | | 0.9% | 13.5% | 8.3% |
| ft/min | % Removal Efficiency | 0.2% | 4.7% | 41.6% | 85.1% | 91.9% | 80.5% | | 2.9% | 88.5% | 89.7% |
| CASE #8 | Feed Mass | 7.50 | 11.25 | 121.05 | 4.65 | 4.50 | 1.05 | | | | |
| Mass In: 150 | Flow Over Screen | | | | | | | | | | |
| BD tons/hour | Mass | 7.41 | 10.79 | 68.17 | 1.04 | 0.54 | 0.17 | 58.7% | | | |
| | % of Flow Over | 8.4% | 12.2% | 77.4% | 1.2% | 0.6% | 0.2% | | 20.6% | 1.8% | 0.8% |
| Loading: 1.58 tons/hr/ft 2 | % Removal Eff. | 98.8% | 95.9% | 56.3% | 22.4% | 12.0% | 16.3% | | 97.0% | 17.3% | 12.8% |
| | Flow Through Screen | | | | | | | | | | |
| Disk RPM: 64.8 | Mass | 0.09 | 0.46 | 52.88 | 3.61 | 3.96 | 0.88 | 41.3% | | | |
| Speed: 284.1 | % of Flow Through | 0.1% | 0.7% | 85.5% | 5.8% | 6.4% | 1.4% | | 0.9% | 12.2% | 7.8% |
| ft/min | % Removal Efficiency | 1.2% | 4.1% | 43.7% | 77.6% | 88.0% | 83.7% | | 3.0% | 82.7% | 87.2% |
| CASE #9 | Feed Mass | 9.50 | 14.25 | 153.33 | 5.89 | 5.70 | 1.33 | | | | |
| Mass In: 190 | Flow Over Screen | | | | | | | | | | |
| BD tons/hour | Mass | 9.35 | 12.92 | 89.96 | 1.55 | 0.77 | 0.26 | 60.4% | | | |
| | % of Flow Over | 8.1% | 11.3% | 78.4% | 1.4% | 0.7% | 0.2% | | 19.4% | 2.0% | 0.9% |
| Loading: 2.00 tons/hr/ft 2 | % Removal Eff. | 98.4% | 90.7% | 58.7% | 26.4% | 13.5% | 19.8% | | 93.8% | 20.0% | 14.6% |
| | Flow Through Screen | | | | | | | | | | |
| Disk RPM: 46.1 | Mass | 0.15 | 1.33 | 63.37 | 4.34 | 4.93 | 1.07 | 39.6% | | | |
| Speed: 202.3 | % of Flow Through | 0.2% | 1.8% | 84.3% | 5.8% | 6.6% | 1.4% | | 2.0% | 12.3% | 8.0% |
| ft/min | % Removal Efficiency | 1.6% | 9.3% | 41.3% | 73.6% | 86.5% | 80.2% | | 6.2% | 80.0% | 85.4% |

What is claimed:

1. A screening system for fractioning and sizing wood chips for use in a pulping digester, comprising:

feeding means for providing a first incoming flow of wood chips at a variable flow rate, said first incoming flow including accepts, overs and unders;

flow management screen means including a horizontal disc screen having a plurality of spaced apart, rotating discs for receiving the first incoming flow and dividing said first flow into a second flow of primarily accepts and overs and a third flow of primarily accepts and unders with the proportion between said first and second flows being variable in response to a control signal that determines the rotational speed of said discs;

a V-disc screen for receiving only the second flow and separating said second flow into a fourth flow of primarily accepts and a fifth flow of primarily overs, said V-disc screen including a plurality of parallel rotatable shafts carrying spaced discs with said shafts being arranged to form a V-shaped configuration to cause said overs to flow generally parallel to the axis of rotation of said shafts and out of said V-disc screen; and control means connected to said flow management screen means for controlling said flow management screen means by generating said control signal to cause said screen means to achieve a desired proportion between said first and second flows, said control means including a means for selecting a speed that the discs of said first screening station should rotate in order to achieve said desired proportions between said first and second flow and, a means for adjusting the selected speed to compensate for differences in the distances between the spaced apart discs of said disc screen resulting from wear.

wherein said first screening station reduces the wear that said flow of chips causes in the V-disc screen by removing unders from said second flow of wood chips.

2. The screen system of claim 1, wherein said control signal further determines the percentage of the unders that the flow management screen means divides out of said first incoming flow.

3. The screening system of claim 1, wherein said means for adjusting said selected speed includes a combination of a look-up table and a programmed logic control.

4. The screening system of claim 1, wherein said V-screen includes a plurality of upstream and downstream rotatable shafts that support and rotate said discs, and said first screening station in particular reduces the wear of the discs on said upstream rotatable shafts.

* * * * *

UNITED STATES PATENT AND TRADEMARK OFFICE

CERTIFICATE OF CORRECTION

PATENT NO. : 5,298,119

DATED : March 29, 1994

INVENTOR(S) : Robert A. Brown

It is certified that error appears in the above-identified patent and that said Letters Patent is hereby corrected as shown below:

On the Title Page item [73], insert after "Va." the following:

--Weyerhaeuser Company,
Tacoma, Wa.--

Signed and Sealed this

Twenty-eight Day of February, 1995

*Attest:*

Bruce Lehman

BRUCE LEHMAN

*Attesting Officer*

*Commissioner of Patents and Trademarks*